US006453793B1

(12) United States Patent
Simonds

(10) Patent No.: US 6,453,793 B1
(45) Date of Patent: Sep. 24, 2002

(54) SPRAG MOTOR

(75) Inventor: Edward L. Simonds, Adel, IA (US)

(73) Assignee: Thermal Dynamics, Inc., Adel, IA (US)

( * ) Notice: Subject to any disclaimer, the term of this patent is extended or adjusted under 35 U.S.C. 154(b) by 0 days.

(21) Appl. No.: 09/713,958

(22) Filed: Nov. 16, 2000

(51) Int. Cl.[7] ..... F01L 33/02
(52) U.S. Cl. ..... 91/345; 91/346; 91/352
(58) Field of Search ..... 91/345, 346, 348, 91/349, 352, 354; 192/41 A

(56) References Cited

U.S. PATENT DOCUMENTS 5,967,016 A 10/1999 Simonds
5,974,943 A 11/1999 Simonds

FOREIGN PATENT DOCUMENTS

DE 3531862 A1 * 3/1987

* cited by examiner

*Primary Examiner*—Edward K. Look
*Assistant Examiner*—Thomas E. Lazo
(74) *Attorney, Agent, or Firm*—Brett J. Trout

(57) ABSTRACT

A motor comprising a shaft with four racks which translate linear actuation of the racks to rotational motion of the shaft through pinions secured to sprag clutch assemblies. Motion of the rack assemblies is preferably offset to maintain a substantially constant rotation of the shaft during operation of the motor. The motor uses a pair of primary fluid expansion chambers to generate linear actuation of a first pair of racks, and a pair of secondary expansion chambers to generate linear actuation of the remaining racks.

13 Claims, 10 Drawing Sheets

10
12
14
16
18
20
22
24
26
28
30
32
34
36
38
40
42
44
46
48
50
52
54
56
58
60
62
64
66
68
70
72
74
76
78
80
82
84
86
88
90

SPRAG MOTOR

BACKGROUND OF THE INVENTION

1. Field of the Invention

The present invention relates in general to motors for converting linear actuation to rotational motion and, more particularly, to a motor for efficiently translating linear actuation into unidirectional rotation of a shaft.

2. Description of the Prior Art

Motor assemblies for translating linear actuation into rotational motion are well known in the art. Typical four stroke combustion engines translate linear actuations of pistons into unidirectional rotation through a camshaft. One drawback of such assemblies is the inefficient conversion of linear actuation into rotational motion. While camshafts do translate linear actuation into rotational motion, they do so efficiently only through a small range of their motion. Throughout the remaining range, only a fraction of the linear actuation is translated into rotational motion. Additionally, as such motors typically operate at high speeds, their components are subject to a high degree of wear and failure.

Alternatively, it is known in the art to provide rack and pinion system for more efficiently translating linear actuation into rotational motion. Unfortunately, a drawback of this system is the inability to continue to rotate a shaft in a single direction. A rack and pinion system typically rotates a pinion, and a shaft connected thereto, in a single rotational direction until the rack reaches the end of its stroke. When the rack is withdrawn, the pinion translates the linear actuation of the rack into rotation of the shaft in the opposite direction. Although this translation of linear actuation into rotational motion is more efficient, the bidirectional rotation of the shaft is undesirable for many applications, and must be inefficiently translated into unidirectional rotational motion for many applications.

Prior art motors, therefore, have numerous disadvantages, including high wear and failure rates, and a lack of efficiency in translating linear actuation into unidirectional rotational motion. It would be desirable to provide a low-wear, high efficiency system for translating linear actuation into unidirectional rotational motion. The difficulties encountered in the prior art discussed hereinabove are substantially eliminated by the present invention.

SUMMARY OF THE INVENTION

In an advantage provided by this invention, a motor is provided for efficient conversion of linear actuation into rotational motion.

Advantageously, this invention provides a motor assembly for converting linear actuation into unidirectional rotational motion.

Advantageously, this invention provides a motor with low maintenance requirements.

Advantageously, this invention provides a motor of a compact size.

Advantageously, this invention provides a motor with low-cost, easily machinable parts.

Advantageously, this invention provides a motor of a durable and longwearing construction.

Advantageously, this invention provides a motor capable of utilizing expansion of exhaust fluid to produce additional rotational motion.

Advantageously, this invention provides a motor for conversion of linear actuation into substantially continuous rotational motion.

Advantageously, in a preferred example of this invention, a motor is provided, comprising a shaft, a first rack operably coupled to the shaft in a manner which rotates the shaft in a first circular direction in response to actuation of the first rack in a first linear direction, a second rack operably coupled to the shaft in a manner which rotates the shaft in the first circular direction in response to actuation of the second rack in a second linear direction, wherein the second linear direction is different than the first linear direction, a first linear actuator coupled to the first rack and a second linear actuator coupled to the second rack.

BRIEF DESCRIPTION OF THE DRAWINGS

The present invention will now be described by way of example, with reference to the accompanying drawings in which.

DETAILED DESCRIPTION OF THE PREFERRED EMBODIMENT

Figure 1:
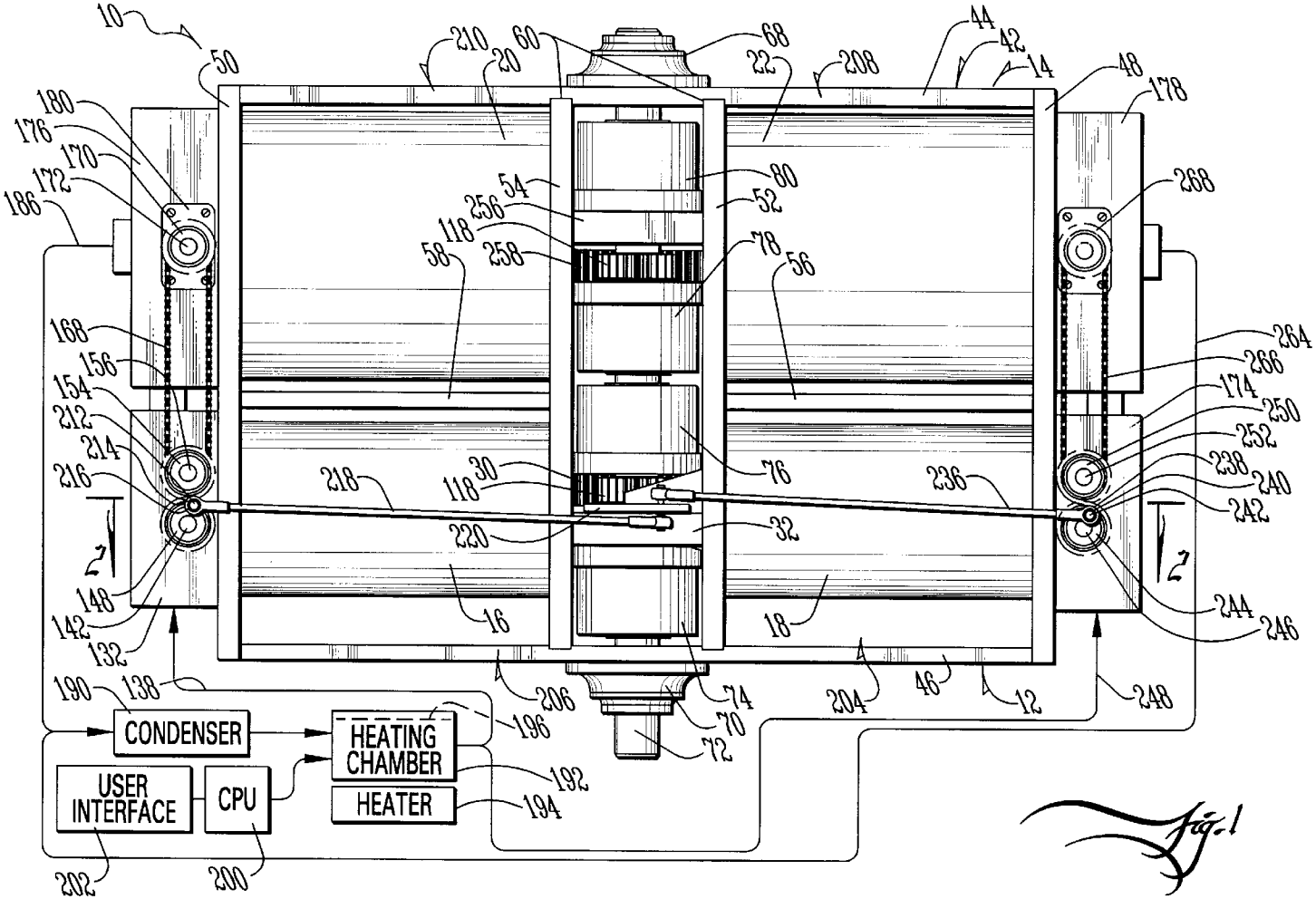
FIG. 1 illustrates an example top elevation of a motor according to this invention.

Referring to FIG. 1, a motor (10) according to this invention is shown comprising a primary actuation assembly (12) and a secondary actuation assembly (14). The primary actuation assembly (12) includes a first expansion chamber (16) and a second expansion chamber (18). The secondary actuation assembly (14) includes a third expansion chamber (20) and a fourth expansion chamber (22). Although the expansion chambers (16), (18), (20) and (22) may be constructed of any suitable material, in the preferred embodiment they are constructed of aluminum. The first and second expansion chambers (16) and (18) are preferably of a diameter between one and one hundred centimeters in diameter, more preferably between five and twenty centimeters in diameter, and in the preferred embodiment ten centimeters in diameter. The third and fourth expansion chambers (20) and (22) are preferably of a diameter between one centimeter and one hundred centimeters, more preferably between a diameter of five centimeters and fifty centimeters, and most preferably a diameter of twenty centimeters. Preferably, the thickness of the aluminum comprising all expansion chambers (16), (18), (20) and (22) is between 0.1 and 5 centimeters, more preferably between 0.5 and 2 centimeters, and most preferably one centimeter.

Figure 2:
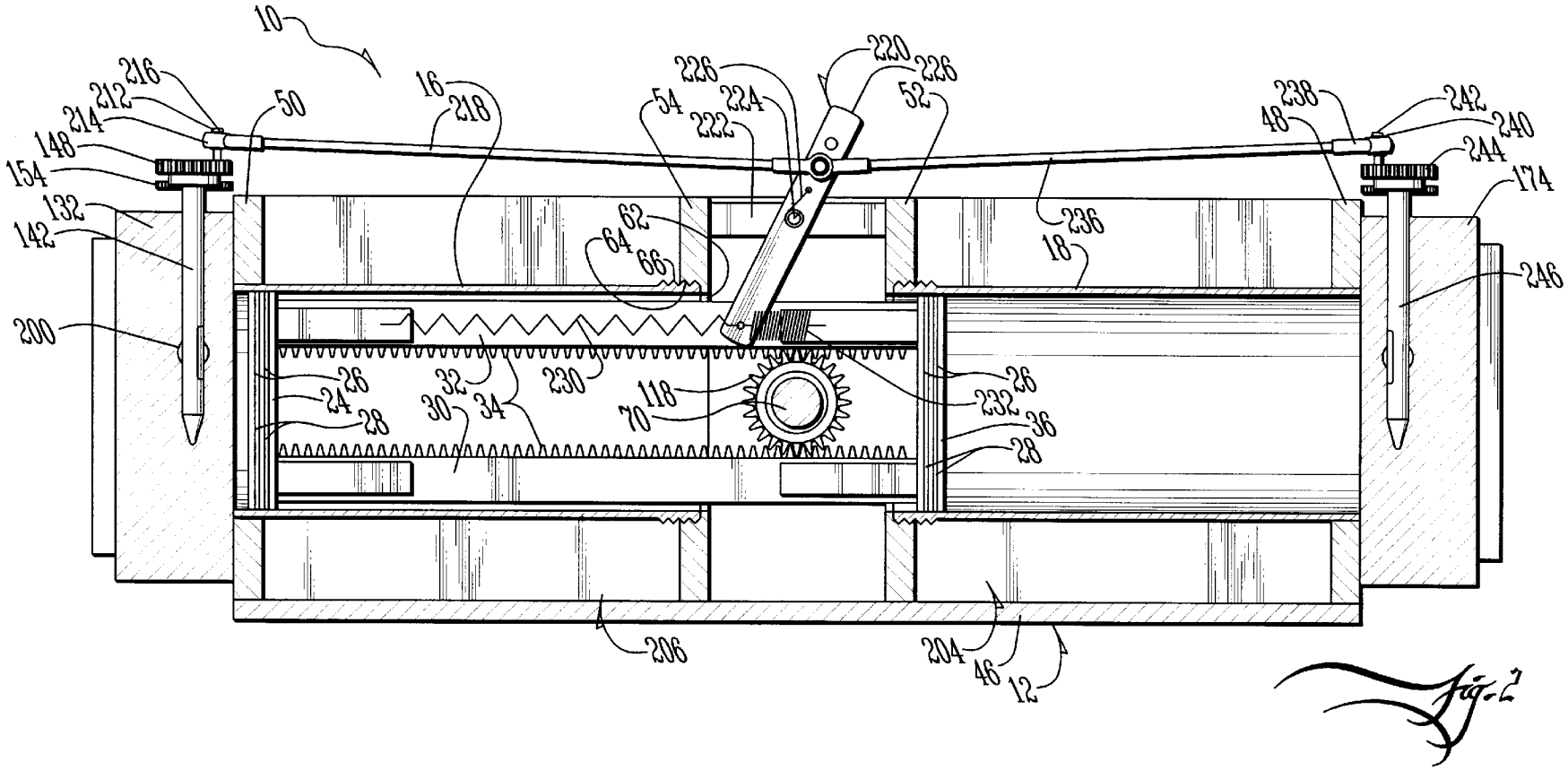
FIG. 2 illustrates a cross-section of the motor taken along Line 2—2 of FIG. 1.

As shown in FIG. 2, provided within the first expansion chamber (16) is a first piston plate (24), constructed of aluminum, preferably two centimeters thick, and provided with a cutout (26) around its perimeter. A steel piston ring (28) is provided within the cutout (26). Secured to the first piston plate (24) by bolts or similar securement means are a first steel rack (30) and second steel rack (32). Each of the racks (30) and (32) are provided with teeth (34) which, of course, may be provided of any suitable number, spacing and dimension, such as those known in the art. The racks (30) and (32) are also secured to a second piston plate (36) by bolts or similar securement means. The second piston plate (36) is provided within the second expansion chamber (18) and is also provided around its perimeter with a cutout (38) and steel piston ring (40).

Figure 3:
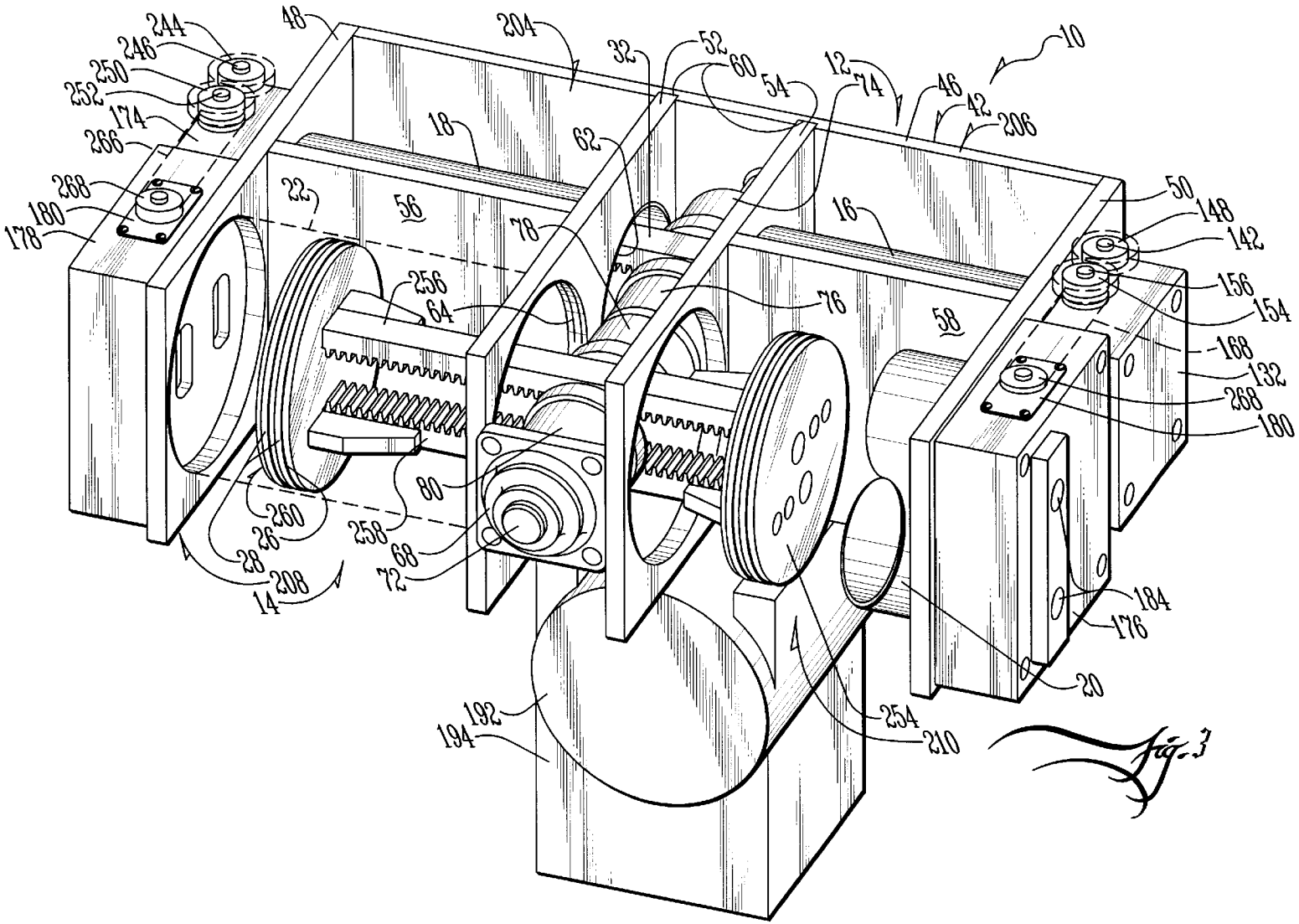
FIG. 3 illustrates a perspective of the motor of FIG. 1 shown with the expansion chambers removed.

As shown in FIG. 1, the motor (10) is provided with a case (42). The case (42) is preferably constructed of two-centimeter thick stainless steel, but may, of course, be constructed of any suitable material, of any suitable dimensions. The case (42) comprises a rear plate (44), a front plate (46), a head plate (48), a foot plate (50), a center head plate (52) and a center foot plate (54). The case (42) also includes a medial head plate (56) and a medial foot plate (58). (FIGS. 1 and 3). As shown in FIG. 1, the rear plate (44) and front plate (46) are provided with cutouts (60) into which are provided the center head plate (52) and center footplate (54). The lear plate (44), front plate (46), head plate (48), foot plate (50), center head plate (52), center foot plate (54), medial head plate (56) and medial foot plate (58) are secured to one another by bolts, but may be secured to one another by weldments or any other securement means known in the art. As shown in FIG. 3, the center foot plate (54) is provided with an opening (62) provided with threads (64). As shown in FIG. 2, the first expansion chamber (16) is provided with threads (66) in mating alignment with the threads (64) provided around the opening (62) of the center foot plate (54). The third expansion chamber (20) is secured to the center foot plate (54) in a similar manner. The second expansion chamber (18) and fourth expansion chamber (22) are secured to the center head plate (52) in a similar manner, but may, of course, be secured by weldments or any other securement means known in the art.

As shown in FIG. 1, secured to the rear plate (44) is a driveshaft bushing (68). Similarly, a second driveshaft bushing (70) is secured to the front plate (46). The bushings (68) and (70) are secured to the case (48) by bolts (not shown) or similar securement means known in the art. The bushings (68) and (70) may be constructed with ball bearings (not shown), Teflon® guides, or any similar bushing material. Provided through, and supported by, the bushings (68) and (70) is a driveshaft (72), preferably constructed of hardened stainless steel and constructed with a four-centimeter diameter.

Figure 4:
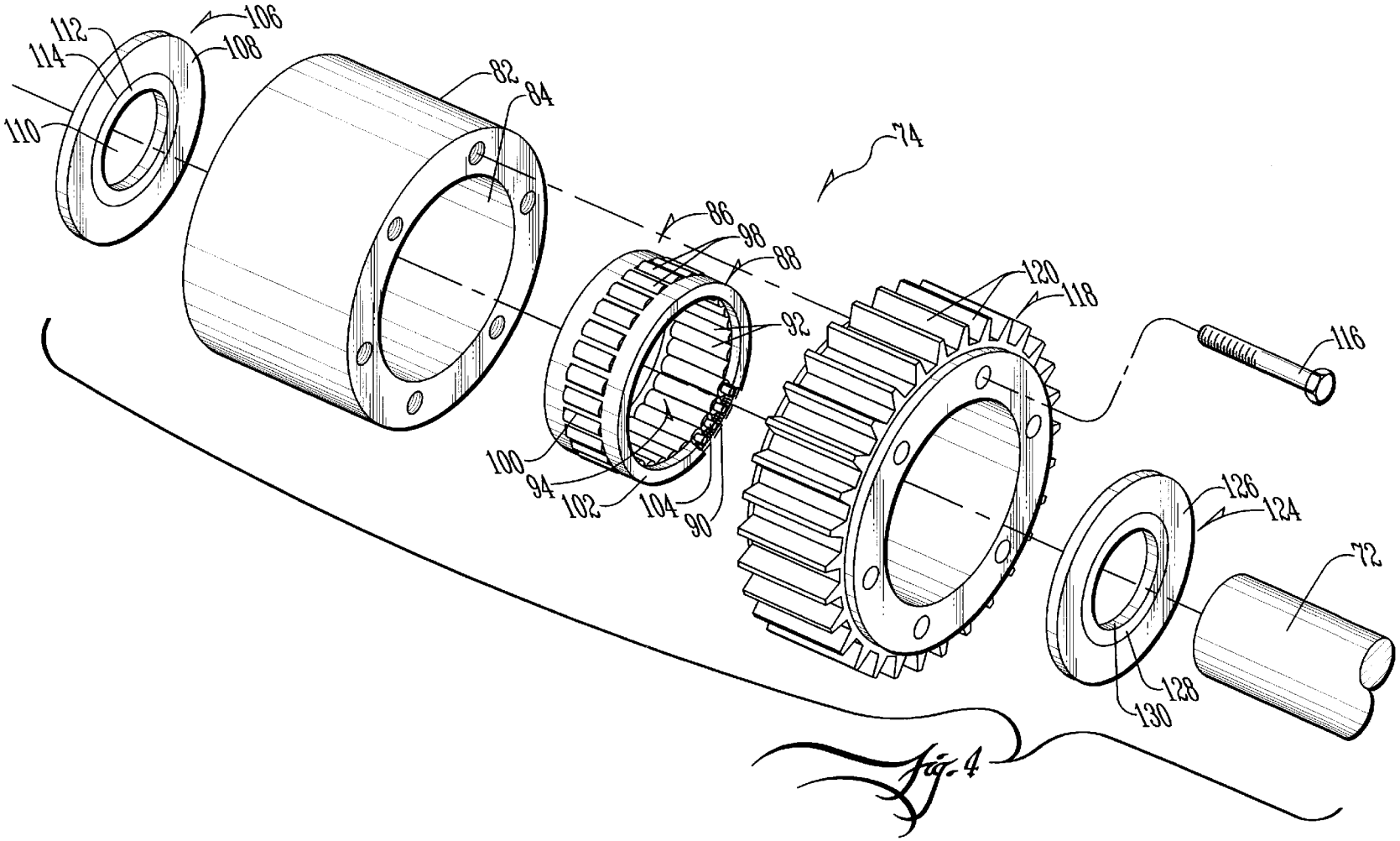
FIG. 4 illustrates an exploded perspective of the sprag and pinion assembly of the motor.

As shown in FIG. 1, the motor (10) is provided with four sprag assemblies (74), (76), (78) and (80). Accordingly, description will only be made relating to the first sprag assembly (74). As shown in FIG. 4, the first sprag assembly (74) comprises a race (82) having an inner annular contact surface (84). Provided within the race (82) is a sprag assembly (86). As shown in FIG. 4, the sprag assembly (86) comprises a sprag retainer (88), a pair of coil springs (90), and a plurality of sprags (92). When the sprag assembly (86) is removed from the race (82) the coil springs (90) bias the sprags (92) into an upright position. When the sprag assembly (86) is positioned within the race (82), there is insufficient distance between the inner annular contact surface (84) and driveshaft (72) to allow the sprags (92) to be biased into their full upright position.

The diameter of the driveshaft (72) is such that the sprags (92) must be tilted slightly to allow insertion of the driveshaft (72), into a cylindrical drive space (94) defined by the plurality of sprags (92). (FIGS. 1 and 4). The sprags (92) are each preferably provided with a body (96) to contact the driveshaft (72) and a head (98) to contact the inner annular contact surface (84) of the race (82). Preferably, the bodies (96) are slightly wider and shorter than the heads (98) and the openings (100) provided in the sprag retainer (88). The width of the bodies (96) prevents the sprags (92) from falling out of the sprag retainer (88). The length of the bodies (96) provides sufficient clearance for placement of the coil springs (90) between the bodies (96) and sidewalls (102) of the sprag retainer (88). Because the bodies (96) are shorter than the heads (98), the coil springs (90) are able to bias an overhanging portion (104) of the heads (98) outward, thereby biasing the sprags (92) toward their upright position.

When the sprag assembly (86) is positioned within the race (82) and the driveshaft (72) is positioned within the drive space (94), the driveshaft (72) is thereby allowed to "freewheel" in a first direction (counter-clockwise as shown) relative to the race (82), because this rotation tilts the sprags (90) away from their upright position. Conversely, the sprag assembly (86) prevents rotation of the driveshaft (72) in the opposite direction (counter-clockwise as shown) relative to the race (82), as this rotation allows the sprags (92) to tilt toward their upright position, thereby wedging the sprags (92) between the driveshaft (72) and the race (82). Accordingly, when the driveshaft (72) is positioned within the drive space (94), the driveshaft (72) is free to rotate in a counter-clockwise direction relative to the race (82), as such rotation tilts the sprags (92) away from their upright position.

Conversely, if attempts are made to rotate the sprag assembly (74) in a clockwise direction, the coil springs (90) bias the sprags (92) toward their upright position, thereby transferring torsional forces of the race (82) to the driveshaft (72). As shown in FIG. 4, a shaft support (106) is provided, comprising an annular steel plate (108) provided with a throughbore (110). Secured within the throughbore (110) by weldments or similar securement means is a bearing assembly (112) such as those bearing assemblies known in the art. The bearing assembly (112) is also provided with a throughbore (114), sized to accommodate the driveshaft (72) and support the shaft support (106) around the driveshaft (72). (FIGS. 1 and 4). The steel plate (108) is bolted or otherwise secured to the race (82) to provide added support for the race (82) on the driveshaft (72). Secured to the opposite side of the sprag assembly (74) by bolts (116), or similar securement means, is a steel pinion (118) provided along its outer surface with teeth (120), sized, configured and spaced to mate with teeth (122) of the second steel rack (32) (FIGS. 2 and 4). The pinion (118) is also bolted to a shaft support (124), comprising a steel plate (126) and a bearing assembly (128) having a throughbore (130).

Figure 5:
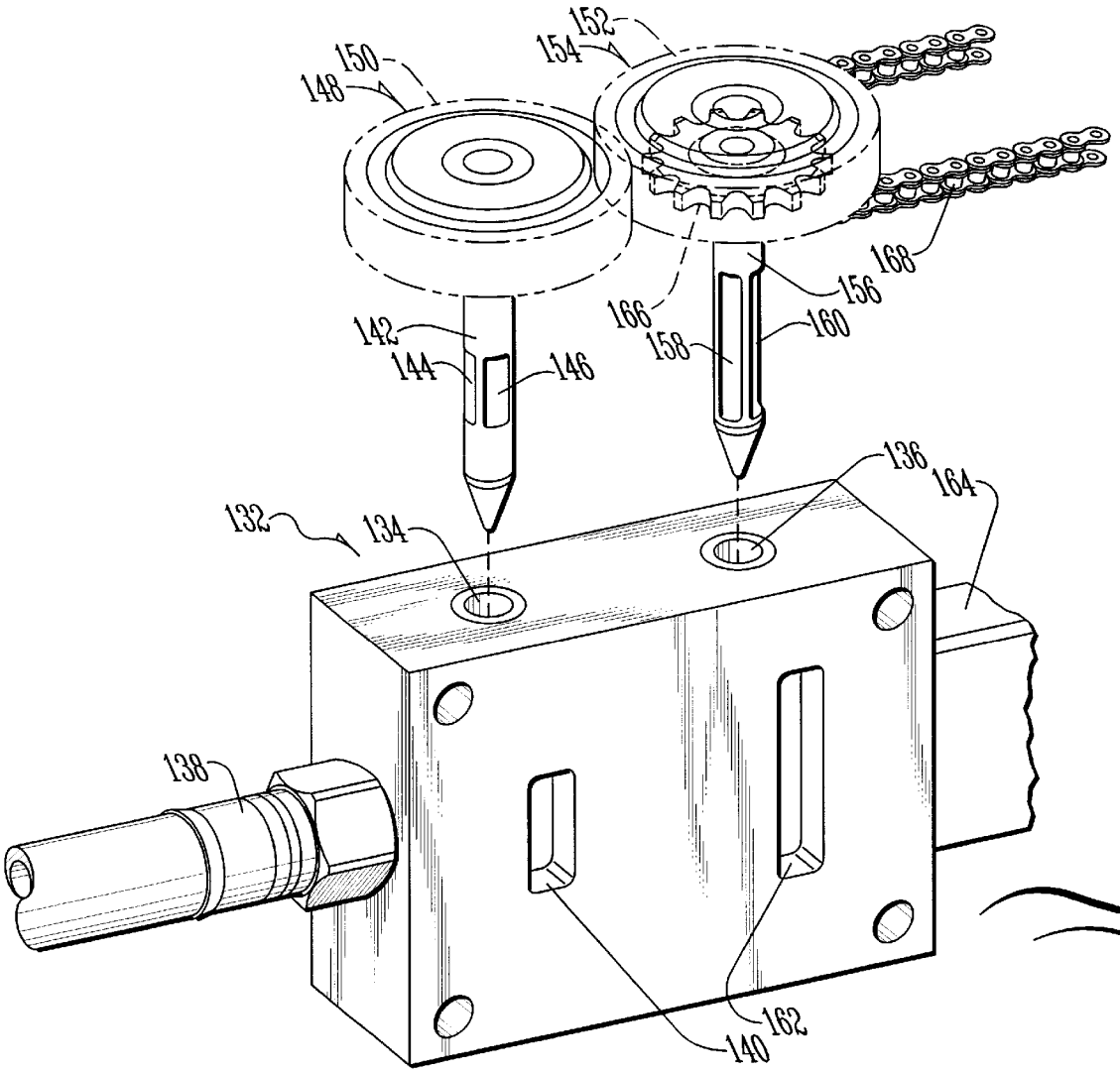
FIG. 5 illustrates a side elevation of a valve case of the motor.

As shown in FIG. 1, the motor (10) is provided with a first valve case (132). As shown in FIG. 5, the first valve case (132) comprises first bore (134) and second bore (136). The first bore (134) is in fluid communication with a first fluid input tube (138) and an injection orifice (140). Provided within the first bore (134) is a first shaft (142) constructed of steel and provided with an intake (144) in fluid communication with an exhaust (146). The intake (144) and exhaust (146) are sized and configured to open fluid communication between the first fluid input tube (138) and the injection orifice (140) when the first shaft (142) is in a first position, and to close off fluid communication between the first fluid input tube (138) and injection orifice (140) when the first shaft (142) is rotated into a second position. Secured to the top of the first shaft (142) by weldments is a first gear (148). The first gear (148) is provided with teeth (150) in mating engagement with teeth (152) provided around a second gear (154), welded to a second shaft (156).

Figure 6:
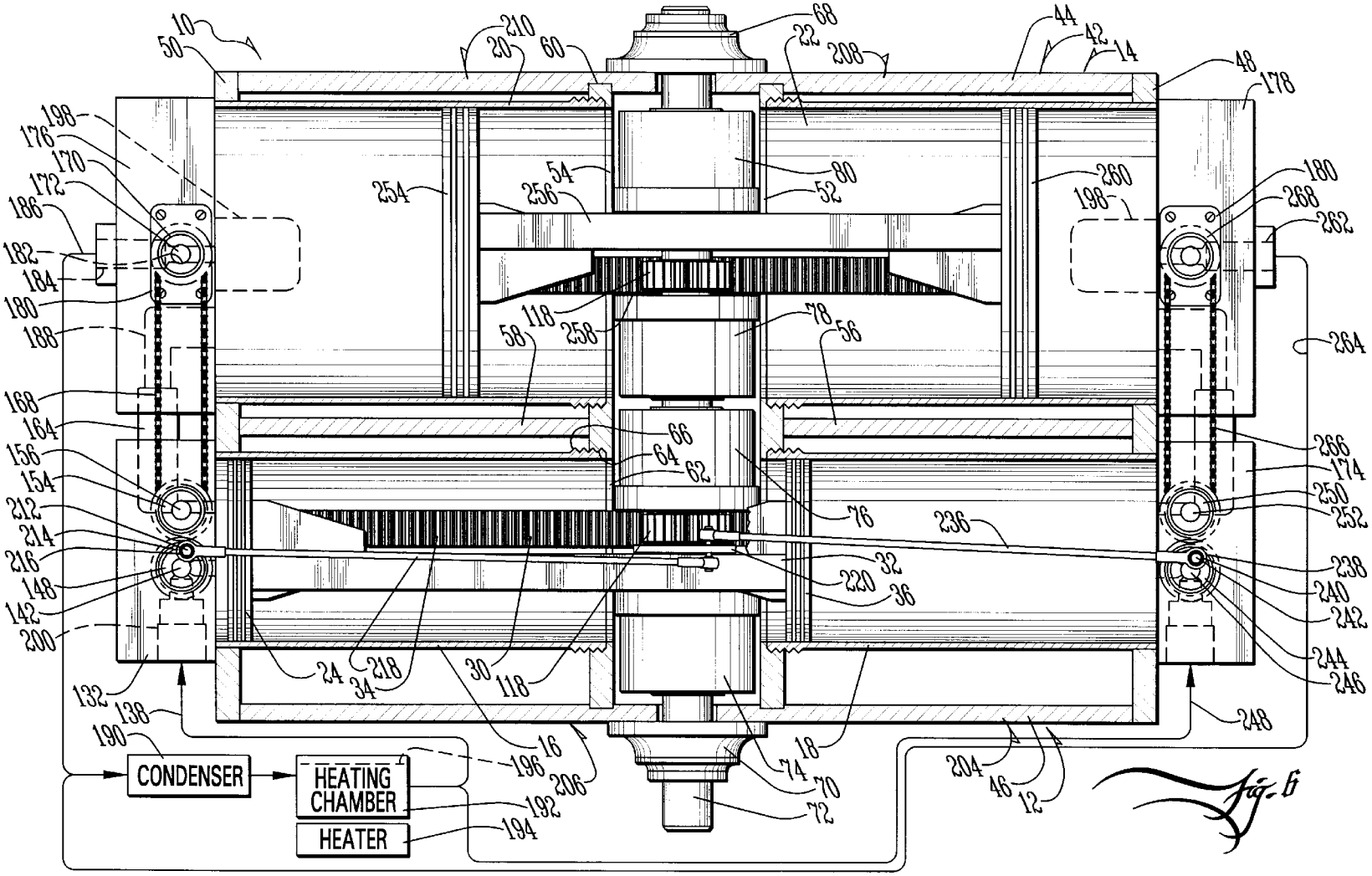
FIG. 6 illustrates a top elevation, in partial phantom, of the motor of FIG. 1, shown with the expansion chambers removed.

As shown in FIG. 6, the second shaft (156) is provided with a large intake (158) in fluid communication with a large exhaust (160). Provided in fluid communication with the second bore (136) are a large exhaust orifice (162) and a fluid transfer tube (164). The second shaft (156), the large intake (158) and large exhaust (160) of the second shaft (156) are sized and configured to open communication between the exhaust orifice (162) and fluid transfer tube (164) when the second shaft (156) is in a first position, and to close off fluid communication between the exhaust orifice (162) and fluid transfer tube (164) when the second shaft (156) is rotated into its second position. Furthermore, the first gear (148) and second gear (154) are configured and oriented so that when the first shaft (142) is in its first position, opening fluid communication between the first fluid input tube (138) and injection orifice (140), the second shaft (156) is in its second position, closing off fluid communication between the exhaust orifice (162) and fluid transfer tube (164). Conversely, when the first shaft (142) is in its second position, closing off fluid communication between the first fluid input tube (138) and injection orifice (140), the second shaft (156) is in a first position, opening fluid communication between the exhaust orifice (162) and fluid transfer tube (164).

Provided around the second shaft (156) is a transmission gear (166) coupled to a chain (168). (FIG. 1). The chain (168) is coupled to a slave gear (170) provided around a slave shaft (172). As shown in FIG. 1, a second valve case (174) is provided over the second expansion chamber (18), a third valve case (176) is provided over the third expansion chamber (20), and a fourth valve case (178) is provided over the fourth expansion chamber (22). The slave shaft (172) is rotatably secured to the third valve case (176) by a bearing plate (180), or similar securement means. Provided through the end of the slave shaft (172) is a throughbore (182) which extends into an exhaust chamber (184) in fluid communication with the third expansion chamber (20) and a first exhaust tube (186). Provided through the third valve case (176) is a fluid transmission chamber (188) in fluid communication with both the fluid transfer tube (164) and the third expansion chamber (20). As shown in FIG. 6, the first exhaust tube (186) coupled to the through bore (184) is also in fluid communication with a condenser (90) which, in turn, is in fluid communication with a heating chamber (192). A heater (194) is coupled to the heating chamber (192) to heat fluid (196) provided within the heating chamber (192). Coupled to the third expansion chamber (20) and fourth expansion chamber (22) are scavenger pumps (198). The scavenger pumps (198) are also connected to the heating chamber (192), to remove and recirculate condensed fluid (196) out of the expansion chambers (20) and (22). Although in the preferred-embodiment the fluid (196) is water; heated and delivered at 375 degrees Fahrenheit and eighteen pounds per square inch, the fluid (196) may be any fluid which produces pressure when heated.

As shown in FIG. 1, the heating chamber (192) is in fluid communication with the fluid input tube (138) of the first expansion chamber (16). As shown in FIG. 1, the heating chamber (192) may be coupled electronically to a central processing unit (200) and user interface (202), or similar control mechanism to monitor and control the heating of the fluid (196) within the heating chamber (192). A second valve case assembly (204) is constructed in a manner similar to that described above in reference to the first valve case assembly (206), albeit in mirror image. A fourth valve case assembly (208) is constructed in a manner similar to that described above in reference to the third valve case assembly (210), albeit in mirror image.

Figure 7:
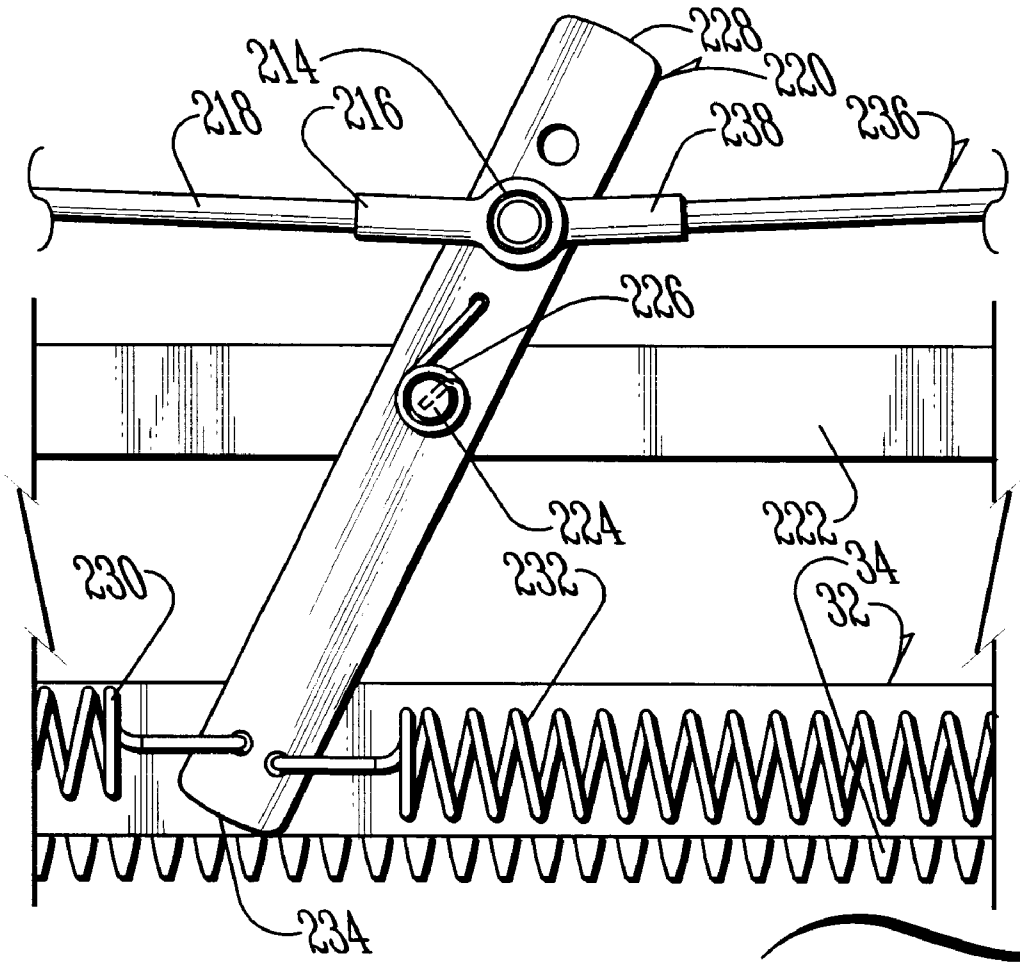
FIG. 7 illustrates a side elevation of the actuation bar assembly of the present invention.

As shown in FIG. 2, a shaft (212) is welded or otherwise secured to the first gear (148). Provided around the shaft (212) is a steel eyelet (214) provided with a bushing (216). Threadably secured to the eyelet (214) is a first actuation shaft (218). As shown in FIG. 7, the actuation shaft (218) is pivotally coupled to an actuation bar (220), which, in turn, is pivotally coupled to a support bar (222) by a bolt (224) or similar pivotal coupling means. The support bar (222) is coupled between the center head plate (52) and center footplate (54) (FIGS. 1 and 7). As shown in FIG. 7, a spring (226) is coupled between the support bar (222) and top (228) of the actuation bar (220).

The actuation bar (220) and spring (226) are assembled in an "over-center" arrangement which prevents the actuation bar (220) from coming to rest perpendicular to the support bar (222). As shown in FIG. 7, the spring (226) is secured to the actuation bar (220) below the bolt (224). Accordingly when the actuation bar (220) is perpendicular to the support bar (222), the spring (226) is in its most extended position. The spring (226) will, therefore, bias the actuation bar (220), either left or right, toward an orientation with less tension on the spring (226). Due to the strength of the spring (226), a large amount of force is required to rotate the actuation bar (220). When such a force is applied to the actuation bar (220), however, the actuation bar (220) rotates quickly past a point perpendicular to the support bar (222). As shown in FIG. 7, a left spring (230) and right spring (232) are coupled between the second steel rack (32) and the bottom (234) of the actuation bar (220). Accordingly, as the second steel rack (32) moves to the right, as shown in FIG. 7, the right spring (232) extends and increases the tension on the bottom (234) of the actuation bar (220) until the force of the right spring (232) overcomes the force of the spring (226), holding the top (228) of the actuation bar (220) in the orientation shown in FIG. 7. Once the force of the right spring (232) overcomes the force of the spring (226), the actuation bar (220) quickly rotates in a counterclockwise manner past a point perpendicular to the support bar (222) and comes to rest with the top (228) of the actuation bar (220) located left of the bottom (234) of the actuation bar (220).

Conversely, when the second steel rack (32) moves to the left as shown in FIG. 7, the left spring (230) extends, increasing tension on the bottom (234) of the actuation bar (220) until the force overcomes the force of the spring (226) holding the actuation bar (220) in place. At that point, the actuation bar (220) snaps back into the orientation shown in FIG. 7. In this manner, the top (228) of the actuation bar (220) is moved very quickly from the full left position to the full right position, only after the second steel rack (32) has fully completed its stroke.

As shown in FIG. 7, also coupled to the top of the actuation bar (226) is a second actuation shaft (236). As shown in FIG. 2, the second actuation shaft (236) is threadably coupled to an eyelet (238) which, in turn, is coupled by a bushing (240) to a shaft (242) coupled to a third gear (244). The third gear (244) is coupled to a third shaft (246) similar in construction to the first shaft (142) described above and capable of allowing fluid into and out of the second expansion chamber (18).

As shown in FIG. 6, to operate the motor (10) of the present invention, the heater (194) is used to heat the fluid (196) provided within the heating chamber (192). In the orientation shown in FIG. 6, the third shaft (246) prevents fluid from entering the second expansion chamber (218) through the second fluid input tube (248). Conversely, the first shaft (142) is oriented so as to allow fluid to pass through the intake (144) and out of the exhaust (146) into the first expansion chamber (16). (FIGS. 5–6). The fluid (196) moves from the heating chamber (192) through the first fluid input tube (138) and into the first expansion chamber (16).

Figure 8:
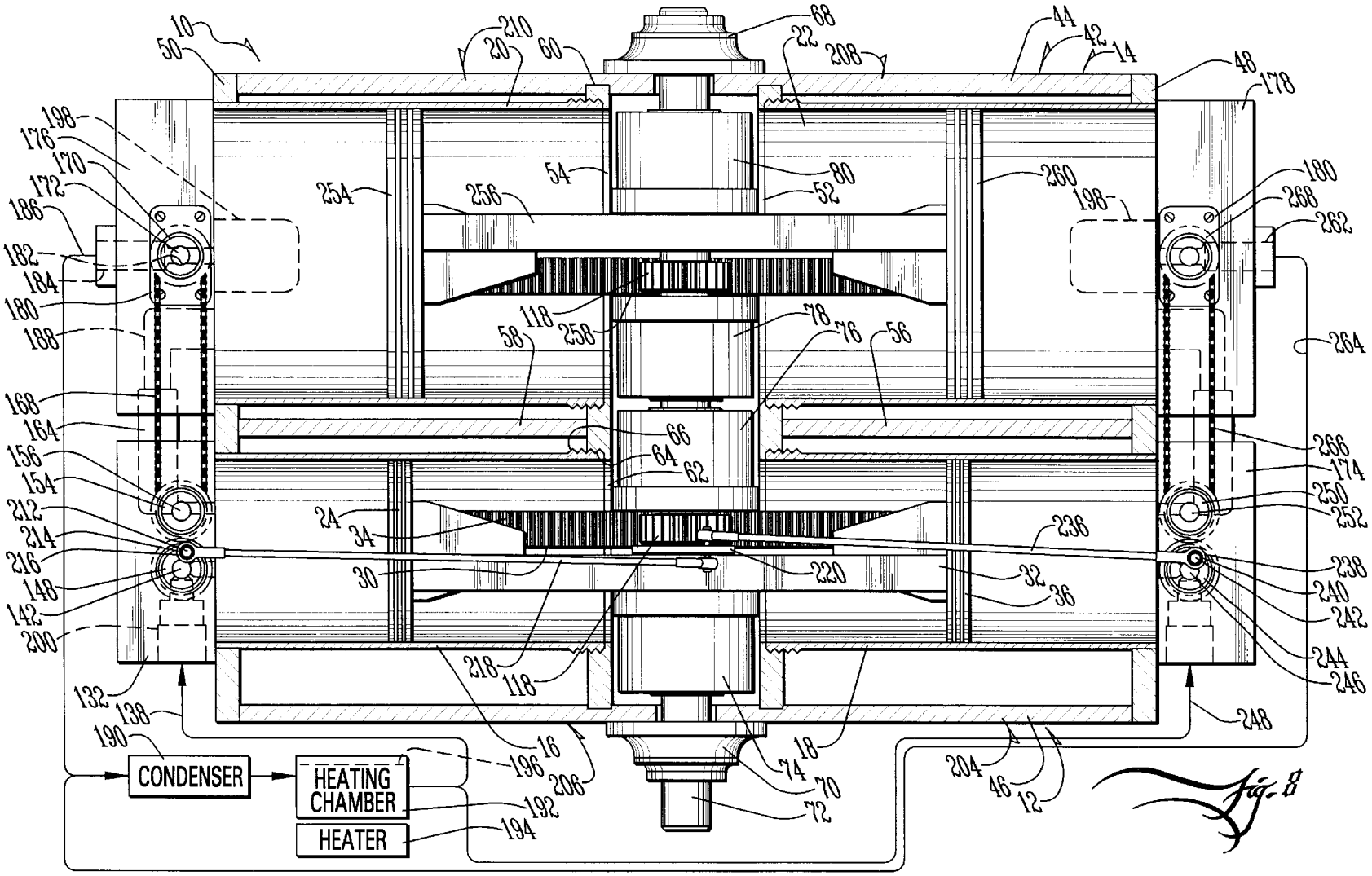
FIG. 8 illustrates a top elevation, in partial phantom, of the motor of FIG. 1, shown with the expansion chambers removed, as fluid is injected into the first expansion chamber.

As shown in FIGS. 1 and 8, as fluid (196) begins to fill the first expansion chamber (16), the first piston plate (24) pushes the first steel rack (30) and second steel rack (32) toward the second piston plate (36). As the fluid (196) presses against the first piston plate (24), the second steel rack (32) engages its associated pinion (118) which, in turn, causes the race (82) to rotate in a clockwise rotation as viewed in FIG. 2. (FIGS. 2, 4 and 8). As the race (82) rotates, the race (82) engages the sprag assembly (86) which locks against the driveshaft (72), causing the driveshaft (72) to rotate in a clockwise direction. As it moves from left to right, the first piston plate (24) causes the first steel rack (30) to rotate its associated pinion (118) and the second sprag assembly (76) in a counterclockwise direction. Because it is rotating in a counterclockwise direction, the second sprag assembly (76) "freewheels", transmitting little or no torque to the driveshaft (72).

Figure 9:
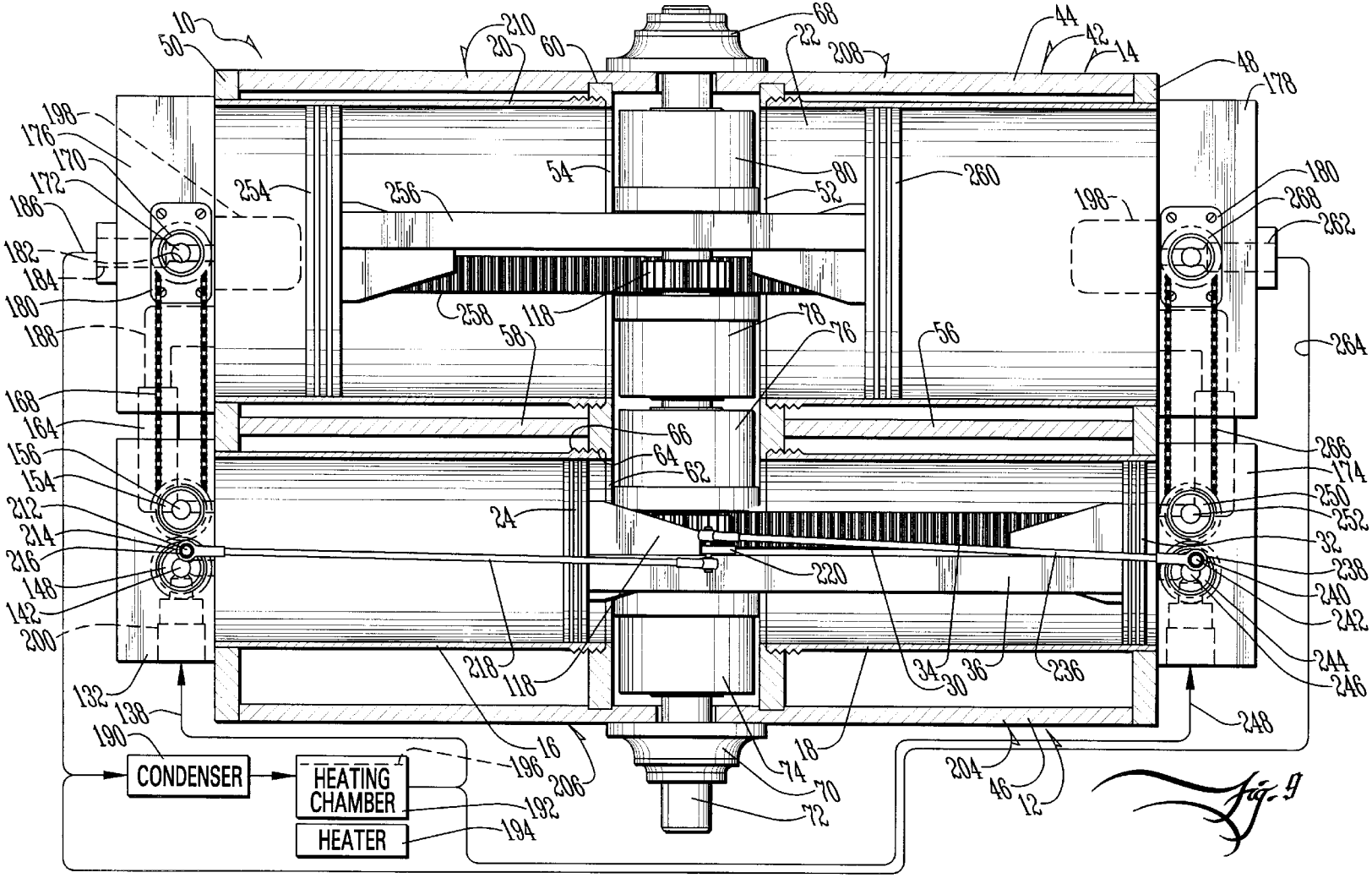
FIG. 9 illustrates a top elevation, in partial phantom, of the motor of FIG. 1, shown with the expansion chambers removed, after fluid is no longer being injected into the first expansion chamber.

As shown in FIGS. 7 and 9, once the first piston plate (24) has reached the center foot plate (54), the tension on the right spring (232) becomes great enough to rotate the actuation bar (220). The rotation of the actuation bar (220) causes the first gear (148) to rotate, closing off the intake (144) and exhaust (146) of the first shaft (142). As it rotates, the first gear (148) rotates the second gear (154) and the second shaft (156) to place the intake (158) and exhaust (160) of the second shaft (156) in fluid communication with the exhaust orifice (162) and fluid transfer tube (164) of the first valve case assembly (206). This allows fluid (196) within the first expansion chamber (16) to escape into the third cylinder (20), through the exhaust orifice (162) and the fluid transmission chamber (188).

Simultaneously, the rotation of the actuation bar (220) rotates the third gear (244), causing the second actuation shaft (236) to open the third shaft (246) and allow fluid (196) to travel through the second fluid input tube (248) and into the second expansion chamber (18). The third gear (244) also rotates the fourth gear (250), which is coupled to the exhaust shaft (252). As the fourth gear (250) rotates, the exhaust shaft (252) closes the fluid communication between the second expansion chamber (18) and fourth expansion chamber (22). (FIG. 1).

Figure 10:
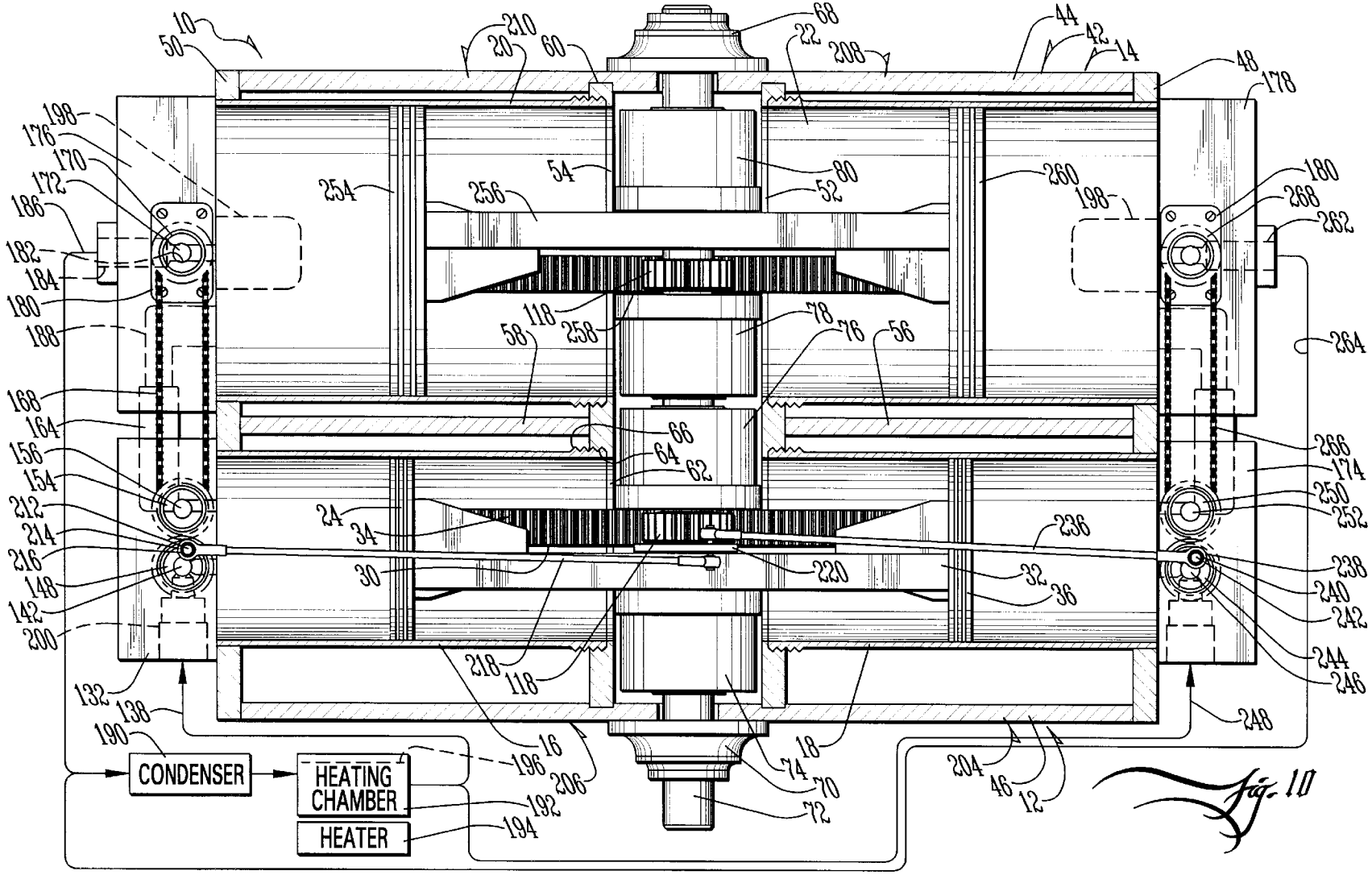
FIG. 10 illustrates a top elevation, in partial phantom, of the motor of FIG. 1, shown with the expansion chambers removed, as fluid is injected into the second expansion chamber.

As fluid (196) enters the second expansion chamber (18), the second piston plate (36) pushes the first steel rack (30) and second steel rack (32) toward the first piston plate (24). (FIG. 10). As the first steel rack (30) engages the second sprag assembly (76), the second sprag assembly (76) converts linear motion of the first steel rack (30) into clockwise rotational motion of the driveshaft (72) in a manner such as that described above in relation to the first sprag assembly (74). (FIG. 10). As the second steel rack (32) moves from right to left across the first sprag assembly (74), the first sprag assembly (74) "freewheels", imparting little or no torque to the driveshaft (72) in the counterclockwise direction.

As the second piston plate (36) continues to force the first steel rack (30) and second steel rack (32) toward the first piston plate (24), the first piston plate (24) forces fluid (196) out of the first expansion chamber (16), through the exhaust orifice (162), through the fluid transfer tube (164), through the fluid transmission chamber (188), and into the third expansion chamber (20). (FIGS. 5 and 10).

As fluid (196) enters the third expansion chamber (20), expansion of the fluid (196) pushes a third piston plate (254) which, in turn, is coupled to a third steel rack (256) and fourth steel rack (258). (FIG. 10). The third steel rack (256) and fourth steel rack (258) are coupled to a fourth piston plate (260). As fluid (196) expands within the third expansion chamber (20), this expansion moves the third piston plate (254), third steel rack (256), fourth steel rack (258), and the fourth piston plate (260). As the fourth piston plate (260) reduces the area within the fourth expansion chamber (22) capable of holding fluid (196), the fluid (196) is forced through an exhaust port (262) and through a second exhaust tube (264), and returns to the condenser (190) for recirculation through the system.

As the third piston plate (254) moves from left to right as shown in FIG. 10, the third steel rack (256) rotates the sprag assembly (80) in a clockwise rotation. The sprag assembly (80) is arranged to engage the driveshaft (72) when moved in a clockwise rotation. Accordingly, the movement of the third steel rack (256) to the right translates into clockwise rotation of the driveshaft (72). Conversely, when the third steel rack (256) moves from right to left, it rotates the sprag assembly (80) in a counterclockwise "freewheel" rotation, imparting little or no torque to the driveshaft (72). When the fourth steel rack (258) moves from left to right as shown in FIG. 10, it rotates the sprag assembly (78) in a counterclockwise "freewheel" orientation, imparting little or no torque to the driveshaft (72). Conversely, as the fourth steel rack (258) moves from right to left, it engages and rotates the sprag assembly (78) clockwise. Accordingly, as the third steel rack (256) moves right, it transfers clockwise rotational torque to the driveshaft (72), and when the fourth steel rack (258) moves left, it also transfers clockwise rotational torque to the driveshaft (72). As can be seen by comparing FIGS. 6 and 10, after the first and second steel racks (30) and (32) finish their stroke, the third and fourth steel racks (256) and (258) continue to move slightly as the pressurized fluid (196) continues to expand until the first and second steel racks (30) and (32) reverse direction. This continued movement of the third and fourth steel racks (256) and (258) allows the motor (10) to provide continuous torque to the driveshaft (72).

The motor (10) is preferably constructed so that once the fluid (196) is pushed out of the first expansion chamber (16) and into the third expansion chamber (20), the top (226) of the actuation bar (220) snaps to the right, thereby shutting off the flow of fluid (196) out of the first expansion chamber (16) through the exhaust orifice (162). (FIGS. 5 and 6). This prevents fluid (196) in the third expansion chamber (20) from returning to the first expansion chamber (16) through the fluid transmission chamber (188). The rotation of the first gear (148), second gear (154), and chain (168) opens the throughbore (182) to allow the fluid (196) to exit the third expansion chamber (20). Simultaneously, the first shaft (142) rotates to allow fluid (196) to enter the first expansion chamber (16) and begin moving the first piston plate (24) to the right.

The rotation of the top (228) of the actuation bar (220) to the right also rotates the third gear (244), fourth gear (250) and, via a chain (266) a slave gear (268). This closes off fluid communication between the second fluid input tube (248) and the second expansion chamber (18), opens fluid communication between the second expansion chamber (18) and fourth expansion chamber (22), and closes off fluid communication between the fourth expansion chamber (22) and the second exhaust tube (264).

As the expanding fluid (196) begins moving the first piston plate (24) to the right, the fluid (196) exits the second expansion chamber (18) into the fourth expansion chamber (22). As the fluid (196) expands within the fourth expansion chamber (22) the expanding fluid (196) moves the fourth piston plate (260) to the left. This action imparts torque to the driveshaft (72) through both the second steel rack (32) and fourth steel rack (258). Once the first piston plate (24) reaches the center footplate (54), the top (226) of the actuation bar (220) snaps back to the left, thereby rotating the first gear (148), second gear (154), and the slave gear (170) via the chain (168). (FIGS. 7 and 9). This closes off ingress of fluid (196) into the first expansion chamber (16) through the injection orifice (140), opens the exhaust orifice (162) to allow fluid (196) to flow into the third expansion chamber (20), and closes off the throughbore (182) to prevent fluid (196) from exiting the third expansion chamber (20).

The rotation of the top (228) of the actuation bar (220) to the left also rotates the third gear (244), fourth gear (250) and, via the chain (266), the slave gear (268). This opens fluid communication between the second fluid input tube (248) and the second expansion chamber (18), closes fluid communication between the second expansion chamber (18) and fourth expansion chamber (22) and opens fluid communication between the fourth expansion chamber (22) and the second exhaust tube (264).

During this process, fluid continues to enter the third expansion chamber (20) from the first expansion chamber (16) and continues to expand, thereby moving the third piston plate (254). This process not only transfers torque to the drive shaft (72) through both the first steel rack (30) and third steel rack (256), but also causes the fourth piston plate (260) to force expanded fluid (196) out of the fourth expansion chamber (22) and back to the condenser (190). Once the second piston plate (36) reaches the center head plate (52), the top (228) of the actuation bar (220) snaps back to the right, and the entire process repeats.

As can be readily determined from the foregoing, the motor (10) can be designed to provide a substantially constant torque to the driveshaft (72), and can be operated at very low or very high speeds simply by adjusting the pressure at which the fluid (196) is provided to the expansion chambers (16) and (18).

Although the invention has been described with respect to a preferred embodiment thereof, it is to be also understood that it is not to be so limited, since changes and modifications can be made therein which are within the full intended scope of this invention as defined by the appended claims. For example it is anticipated that any number of expansion chambers may be used, and that the process may include several pairs of expansion chambers to fully obtain the benefit of the particular fluid (196) utilized in association with the motor (10) of the present invention.

What is claimed is:

1. A motor comprising:

(a) a shaft;

(b) a first rack operably coupled to said shaft in a manner which rotates said shaft in a first circular direction in response to actuation of said first rack in a first linear direction;

(c) a second rack operably coupled to said shaft in a manner which rotates said shaft in said first circular direction in response to actuation of said second rack in a second linear direction wherein said second linear direction is different than said first linear direction;

(d) a first linear actuator coupled to said first rack;

(e) a second linear actuator coupled to said second rack;

(f) a first expansion chamber provided with a first inlet and a first outlet;

(g) a first piston movable within said first expansion chamber, said first piston operably coupled to said first rack;

(h) a second expansion chamber provided with a second inlet and a second outlet; and (i) a second piston movable within said second expansion chamber, and said piston operably coupled to said second rack.

2. The motor of claim 1, further comprising means coupled to said first expansion chamber for substantially preventing said first inlet and said first outlet from being in simultaneous open fluid communication with said first expansion chamber.

3. The motor of claim 2, means coupled to said first rack for actuating said preventing means.

4. A motor comprising:

(a) a shaft;

(b) a first rack operably coupled to said shaft in a manner which rotates said shaft in a first circular direction in response to actuation of said first rack in a first linear direction;

(c) a second rack operably coupled to said shaft in a manner which rotates said shaft in said first circular direction in response to actuation of said second rack in a second linear direction wherein said second linear direction is different than said first linear direction;

(d) a first linear actuator coupled to said first rack;

(e) a second linear actuator coupled to said second rack;

(f) a third rack operably coupled to said shaft in a manner which rotates said shaft in said first circular direction in response to actuation of said third rack in a third linear direction; and (g) a third linear actuator coupled to said third rack.

5. The motor of claim 4, further comprising:

(a) a fourth rack operably coupled to said shaft in a manner which rotates said shaft in said first circular direction in response to actuation of said fourth rack in a fourth linear direction; and (b) a fourth linear actuator coupled to said fourth rack.

6. The motor of claim 5, wherein said first linear direction is substantially the same as said third linear direction, and wherein said second linear direction is substantially the same as said fourth linear direction.

7. The motor of claim 6, further comprising:

(a) a supplemental overrunning clutch assembly comprising:

(i) a supplemental race having a supplemental inner annular contact surface;

(ii) a supplemental plurality of sprags provided along said supplemental inner annular contact surface of said supplemental race, said supplemental plurality of sprags defining a supplemental drive space, (iii) wherein said supplemental drive space is provided around said shaft;

(iv) supplemental means for maintaining said supplemental plurality of sprags along said supplemental inner annular contact surface.

(b) a second supplemental overrunning clutch assembly comprising:

(i) a second supplemental race having a second supplemental inner annular contact surface;

(ii) a second supplemental plurality of sprags provided along said second supplemental inner annular contact surface of said second supplemental race, said second supplemental plurality of sprags defining a supplemental drive space, (iii) wherein said second supplemental drive space is provided around said shaft;

(iv) second supplemental means for maintaining said second supplemental plurality of sprags along said second supplemental inner annular contact surface.

(c) a third supplemental overrunning clutch assembly comprising:

(i) a third supplemental race having a third supplemental inner annular contact surface;

(ii) a third supplemental plurality of sprags provided along said third supplemental inner annular contact surface of said third supplemental race, said third supplemental plurality of sprags defining a third supplemental drive space, (iii) wherein said third supplemental drive space is provided around said shaft;

(iv) a third supplemental means for maintaining said third supplemental plurality of sprags along said third supplemental inner annular contact surface.

8. The motor of claim 7, further comprising:

(a) a first pinion in operable engagement with said first rack, said first pinion being secured to said overrunning clutch assembly;

(b) a second pinion in operable engagement with said second rack, said second pinion being secured to said overrunning clutch assembly, (c) a third pinion in operable engagement with said third rack, said third pinion being secured to said overrunning clutch assembly;

(d) a fourth pinion in operable engagement with said fourth rack, said fourth pinion being secured to said overrunning clutch assembly.

9. The motor of claim 8, further comprising:

(a) a first expansion chamber provided with a first inlet and a first outlet;

(b) a first piston movable within said first expansion chamber, said first piston operably coupled to said first rack;

(c) a second expansion chamber provided with a second inlet and a second outlet; and (d) a second piston movable within said second expansion chamber, and said piston operably coupled to said second rack.

(e) a third expansion chamber provided with a first inlet and a first outlet;

(f) a third piston movable within said third expansion chamber, said third piston operably coupled to said first rack;

(g) a fourth expansion chamber provided with a second inlet and a second outlet; and (h) a fourth piston movable within said second expansion chamber, and said fourth piston operably coupled to said second rack.

10. The motor of claim 9, further comprising:

(a) means coupled to said first expansion chamber for substantially preventing said first inlet and said first outlet from being in simultaneous open fluid communication with said first expansion chamber;

(b) supplemental means coupled to said second expansion chamber for substantially preventing said second inlet and said second outlet from being in simultaneous open fluid communication with said second expansion chamber;

(c) second supplemental means coupled to said second expansion chamber for substantially preventing said second inlet and said second outlet from being in simultaneous open fluid communication with said second expansion chamber;

(d) third supplemental means coupled to said third expansion chamber for substantially preventing said third inlet and said third outlet from being in simultaneous open fluid communication with said third expansion chamber; and (e) third supplemental means coupled to said fourth expansion chamber for substantially preventing said fourth inlet and said fourth outlet from being in simultaneous open fluid communication with said fourth expansion chamber.

11. The motor of claim 10, further comprising means coupled to said first rack for actuating said preventing means.

12. The motor of claim 10, further comprising:

(a) means coupling said first outlet into fluid communication with said third inlet and;

(b) means coupling said second outlet into fluid communication with said fourth inlet.

13. The motor of claim 12, further comprising means for synchronizing a flow of a fluid into said first expansion chamber, said second expansion chamber, said third expansion chamber and said fourth expansion chamber in a manner which produces a substantially continuous rotation of said shaft in said first circular direction.

* * * * *